US008499890B2

(12) United States Patent
Stone et al.

(10) Patent No.: US 8,499,890 B2
(45) Date of Patent: Aug. 6, 2013

(54) PERSONAL ESCAPE DEVICE

(75) Inventors: Kevin R. Stone, Mill Valley, CA (US); Michael Strasser, San Franciso, CA (US); Thomas King, San Francisco, CA (US); Imraan Aziz, Oakland, CA (US)

(73) Assignee: Rescue Reel, LLC, San Francisco, CA (US)

( * ) Notice: Subject to any disclaimer, the term of this patent is extended or adjusted under 35 U.S.C. 154(b) by 198 days.

(21) Appl. No.: 12/688,772

(22) Filed: Jan. 15, 2010

(65) Prior Publication Data

US 2010/0163343 A1 Jul. 1, 2010

Related U.S. Application Data

(63) Continuation-in-part of application No. 12/218,922, filed on Jul. 18, 2008.

(60) Provisional application No. 61/145,950, filed on Jan. 20, 2009, provisional application No. 61/225,414, filed on Jul. 14, 2009, provisional application No. 60/950,451, filed on Jul. 18, 2007.

(51) Int. Cl.
*A62B 1/10* (2006.01)

(52) U.S. Cl.
USPC ..... 182/234; 182/231; 182/239

(58) Field of Classification Search
USPC ..... 182/234, 239, 231
See application file for complete search history.

(56) References Cited

U.S. PATENT DOCUMENTS

| | | | | |
|---|---|---|---|---|
| 3,677,521 | A * | 7/1972 | Kinnicutt, Jr. | 254/283 |
| 4,256,199 | A * | 3/1981 | Sellards | 182/11 |
| 4,938,435 | A * | 7/1990 | Varner et al. | 244/142 |
| 7,237,651 | B2 | 7/2007 | Avots | |
| 2005/0023085 | A1 * | 2/2005 | Munton | 182/239 |
| 2007/0240940 | A1 * | 10/2007 | Moriarty | 182/238 |
| 2008/0314685 | A1 * | 12/2008 | Verstegen et al. | 182/231 |

FOREIGN PATENT DOCUMENTS

| | | | |
|---|---|---|---|
| EP | 272908 | A2 * | 6/1988 |
| JP | 04075671 | A * | 3/1992 |

* cited by examiner

*Primary Examiner* — Alvin Chin Shue
(74) *Attorney, Agent, or Firm* — Lathrop & Gage LLP

(57) ABSTRACT

A personal escape device which can be used by men, women, and children, including physically disabled persons, to descend in a controlled and secure manner from high structures such as office buildings, multistory homes, and the like. The device is designed for a relatively low-cost, small size which may be used by payloads of variable weights. The rescue device of the invention may be a single-use device or a multi-use device.

12 Claims, 14 Drawing Sheets

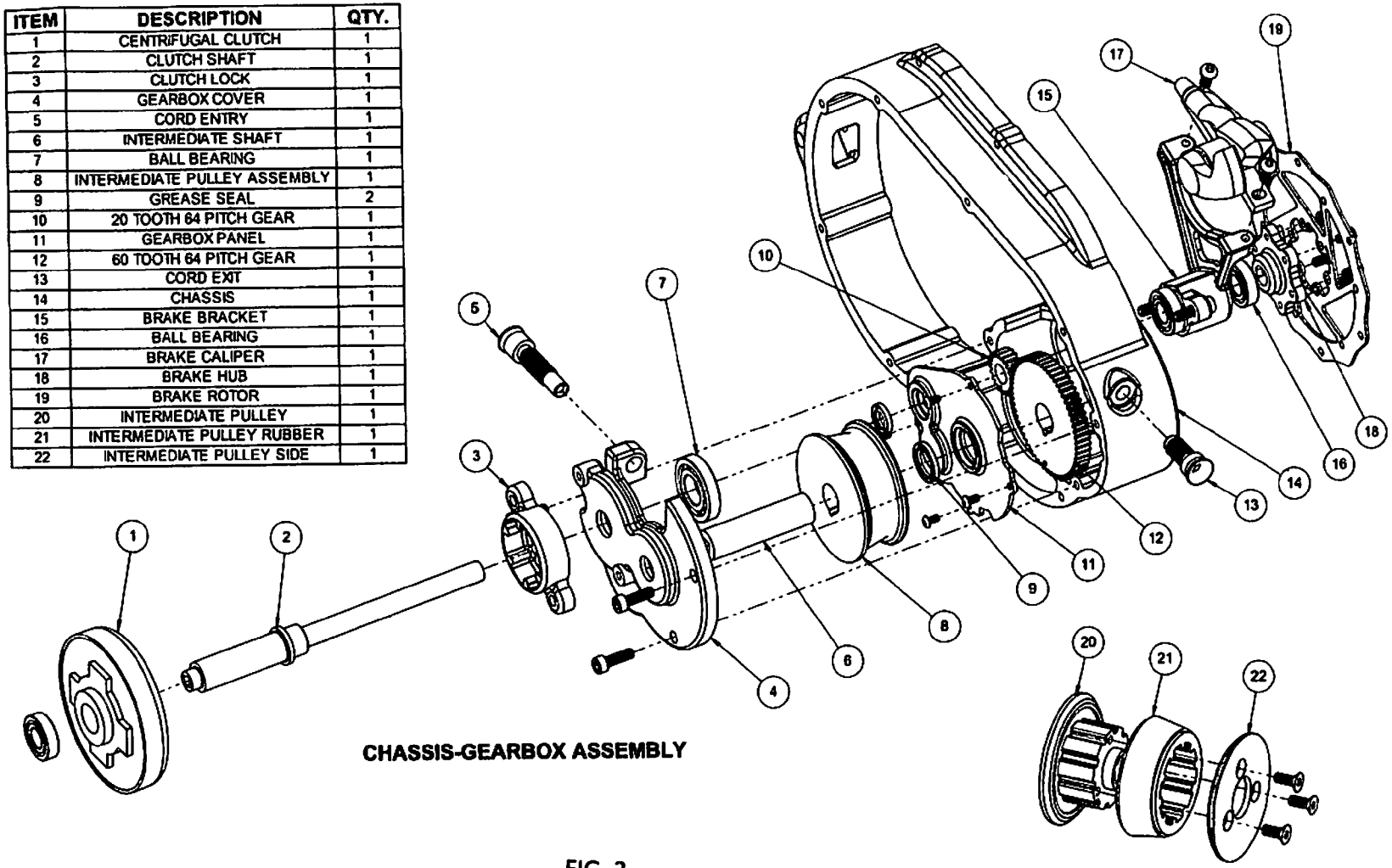

| ITEM | DESCRIPTION | QTY. |
|---|---|---|
| 1 | CENTRIFUGAL CLUTCH | 1 |
| 2 | CLUTCH SHAFT | 1 |
| 3 | CLUTCH LOCK | 1 |
| 4 | GEARBOX COVER | 1 |
| 5 | CORD ENTRY | 1 |
| 6 | INTERMEDIATE SHAFT | 1 |
| 7 | BALL BEARING | 1 |
| 8 | INTERMEDIATE PULLEY ASSEMBLY | 1 |
| 9 | GREASE SEAL | 2 |
| 10 | 20 TOOTH 64 PITCH GEAR | 1 |
| 11 | GEARBOX PANEL | 1 |
| 12 | 60 TOOTH 64 PITCH GEAR | 1 |
| 13 | CORD EXIT | 1 |
| 14 | CHASSIS | 1 |
| 15 | BRAKE BRACKET | 1 |
| 16 | BALL BEARING | 1 |
| 17 | BRAKE CALIPER | 1 |
| 18 | BRAKE HUB | 1 |
| 19 | BRAKE ROTOR | 1 |
| 20 | INTERMEDIATE PULLEY | 1 |
| 21 | INTERMEDIATE PULLEY RUBBER | 1 |
| 22 | INTERMEDIATE PULLEY SIDE | 1 |

CHASSIS-GEARBOX ASSEMBLY

FIG. 3

| ITEM | DESCRIPTION | QTY. |
|---|---|---|
| 23 | RIGHT HANDLE | 1 |
| 24 | RIGHT SHELL | 1 |
| 25 | SUPPLY SPOOL | 1 |
| 26 | CHASSIS ASSEMBLY | 1 |
| 27 | SPOOL SHAFT | 1 |
| 28 | LEFT SHELL | 1 |
| 29 | LEFT HANDLE | 1 |
| 30 | BRAKE LEVER | 1 |

Physical Properties

Dimensions - 14.79"x13.49"x8.80"
Weight - 22 lb
Housing Material - Aluminum spine w/ ABS shell

Sourced Components

Line - 5mm Tech Cord by New England Ropes
Clutch - Modified Hilliard dual-shoe clutch w/ compression springs
Brake - Avid BB5 by SRAM w/ 140mm rotor
Carabiner - ISO Cold-forged Locking Oval by Omega Pacific
Harness - Pitagor Rescue Triangle by Petzl

Operational Properties

Maximum Use Height - 30 stories (390ft)*
Descent Speed - 6 ft/s
User Weight - 75-300 lb

Component Limitations

Line - 5,000 lb tensile strength
Carabiner - 5,000 lb breaking strength
Harness - 4,500 lb breaking strength

*400 ft of line are included in the device for navigation of building exit and to comply with ASTM standards

FIG 10

PERSONAL ESCAPE DEVICE

REFERENCE TO RELATED APPLICATIONS

This application is a continuation-in-part of, and claims priority to, U.S. Provisional Patent Application Ser. No. 60/950,451, filed Jul. 18, 2007, U.S. patent application Ser. No. 12/218,922, filed Jul. 18, 2008, U.S. Provisional Patent Application Ser. No. 61/145,950, filed Jan. 20, 2009, and U.S. Provisional Patent Application Ser. No. 61/225,414, filed Jul. 14, 2009, all incorporated herein fully by reference.

FIELD OF INVENTION

The present invention relates to emergency equipment and personal safety devices involving exiting a tall building in event of an emergency.

BACKGROUND

Each year, an estimated ten thousand fires occur in buildings that are seven stories or higher. Hundreds of firefighters and police risk their life every day by entering burning buildings to save trapped civilians. Additionally, terrorism, hostage situations, and violent crime rampages worldwide are increasing, often leaving people trapped high above the streets, waiting for rescue.

An estimated 2,726 people died on Sep. 11, 2001, at the World Trade Center in New York City. Of that number, 343 were firemen who entered the building to save lives. An estimated 200 people were trapped civilians who willingly jumped from the buildings before the buildings collapsed. Though 9/11 was an extreme situation, it is not uncommon for victims of high rise fires to jump as a last resort to escape smoke and fire. For many fire victims, exit routes are too slow or inaccessible due to extremely hot flames and smoke. For overweight or physically impaired individuals, stairs are not an option. Too frequently victims are trapped and forced to wait for rescue.

Over the years, many devices have been created attempting to address the problem of controlled descent in an emergency situation, either to prevent work-related falls or for emergency descent from buildings. Many of these prior art devices rely solely upon hydraulic or other fluid braking systems. Such devices have a relatively short life, depending on the nature of the fluid, and risk failure due to low or insufficient fluid levels. Because emergency situations rarely occur, and even more rarely occur more than once for a single building, emergency devices must be able to be stored for extended periods of time without maintenance without any risk of degradation of functionality.

Other prior art devices are manual in nature. U.S. Pat. No. 5,842,542, uses a manual braking system, such as a rope windlass system, to slow the passage of a rope as the person descends. However, wear on the rope caused by the friction of the manual braking system makes such a system dependent upon the abilities of the user, thus are less reliable for members of the population who do not have the capacity to exert sufficient force to slow the descent.

Yet other prior art devices include a complexity of mechanics to make them unwieldy and inherently less reliable. Such devices are found in U.S. Pat. No. 3,946,989, and U.S. Pat. No. 6,745,872. Not only are such complex mechanisms expensive to manufacture, the multiple parts makes them inherently unreliable. Similarly, prior art devices that include spring mechanisms, such as that found in U.S. Pat. No. 3,760,910, include an element that may not store over time, may break under certain heavier weights, or may not extend sufficiently under certain lighter weights.

Thus, there remains a need for a reliable device for enabling the controlled descent of persons of a range of ages, weights, and abilities from high buildings in emergency situations.

DESCRIPTION OF THE DRAWING

FIG. 3 shows an exploded view of the chassis-gear box assembly of the embodiment of FIG. 1.

FIG. 10 shows a table listing exemplary characteristics of embodiments of the invention.

DESCRIPTION OF THE INVENTION

The present invention provides a personal escape device which can be used by men, women, and children, including physically disabled persons, to descend in a controlled and secure manner from high structures such as office buildings, multistory homes, and the like. The device is designed for a relatively low-cost, small size which may be used by payloads of variable weights. The rescue device of the invention may be a single-use device or a multi-use device.

Figure 1:
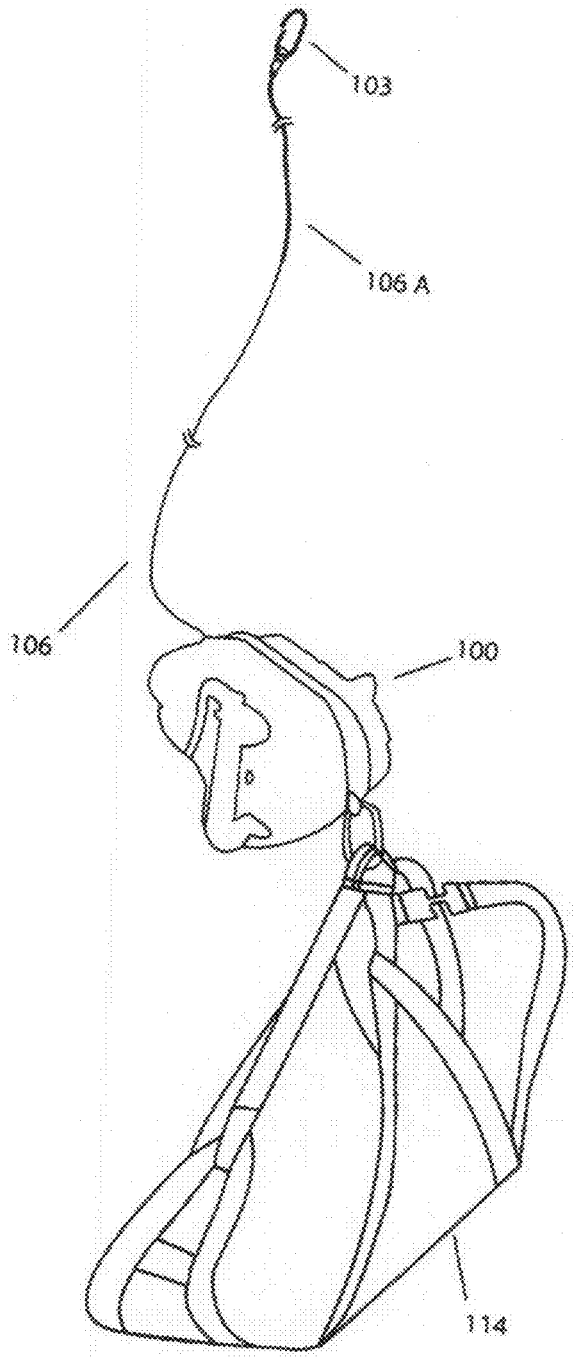
FIG. 1 is a perspective view of a personal escape device in accordance with certain embodiments of the invention.

An embodiment of the personal escape system of the present invention is illustrated in FIG. 1, including (i) a personal escape device 100, (ii) a cord 106, for example, synthetic or metal cwire, extending from device 100 and having a reinforced distal end 106A coupled to an anchoring assembly 103, and (iii) a payload-bearing harness 114. These elements are generally similar to correspondingly numbered elements in the incorporated references. However, the personal escape device 100 is different, as described below.

Figure 2:
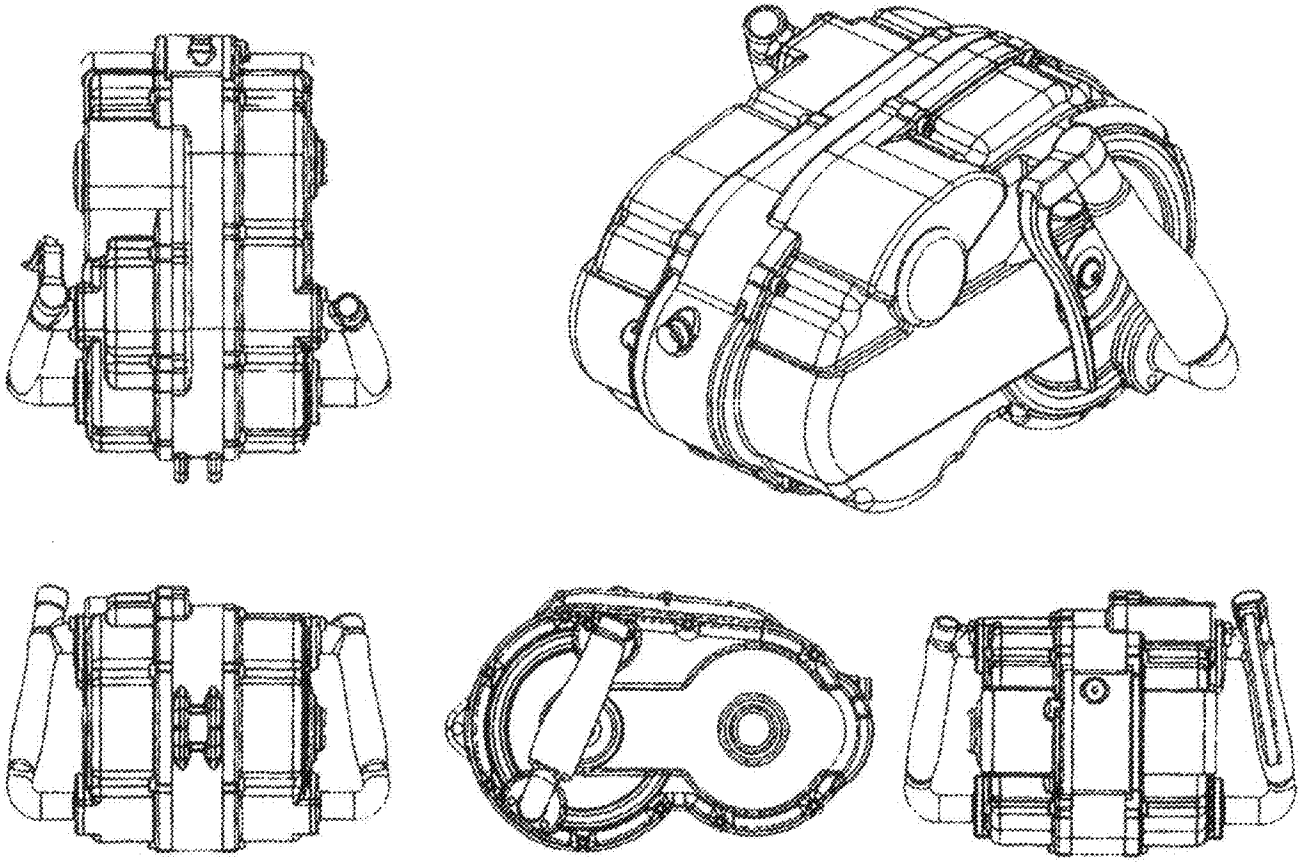
FIG. 2 shows in plan views and perspective view, and exemplary embodiment of the personal escape device of FIG. 1.

Personal escape device 100 is shown in plan view and perspective view in FIG. 2, and includes a housing assembly disposed about a chassis-gearbox assembly. The chassis-gearbox assembly is shown in exploded form in FIG. 3, and the housing assembly is shown in exploded form in FIG. 4.

Figure 4:
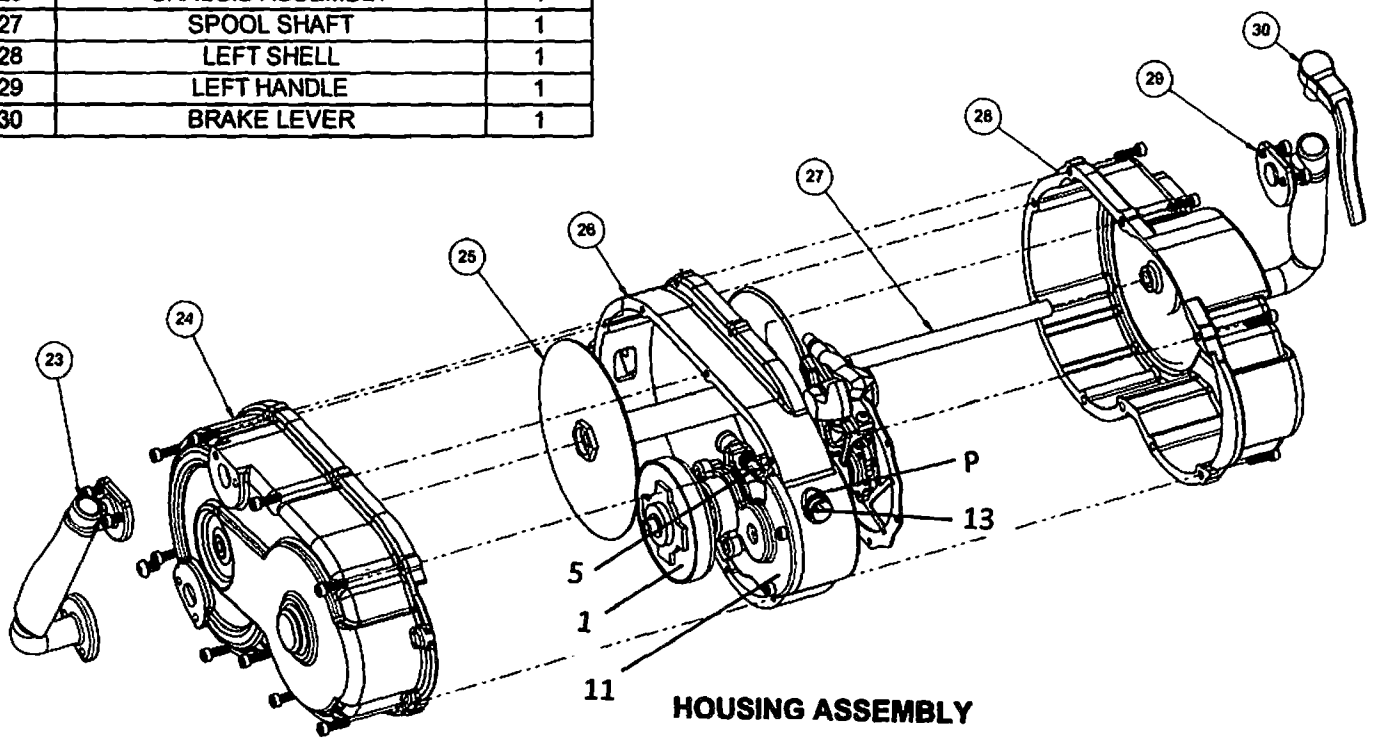
FIG. 4 shows an exploded view of the housing assembly of the embodiment of FIG. 1.

As shown in FIG. 4, the housing includes right shell 24 and left shell 28, disposed on respective sides of a chassis assembly 26. A right handle 23 and a left handle 29 are coupled to the outside surfaces of right shell 24 and left shell 28, respectively, providing handholds for a user when positioned in the harness 114. A supply spool 25 is disposed within the housing, extending along a spool shaft 27, and rotatable about a central axis thereof. A brake lever 30 is coupled to a brake assembly within the housing.

As shown in FIG. 3, the chassis assembly 26 includes a chassis 14 (which is coupled to right shell 24 and left shell 28), having a cord exit port 13 disposed about an axis generally perpendicular to the central axis of the spool within the housing. As will be described below, the cord exit port 13 provides a path through which cord 106 plays out from spool 25. The chassis assembly 26 further includes an intermediate shaft 6, which is parallel to the central axis. An intermediate, or idler, pulley assembly 8 is disposed on and affixed to intermediate, or idler, shaft 6. The intermediate pulley assembly 8 includes intermediate pulley 20, intermediate pulley member 21, an intermediate pulley side plate 22. The elements of intermediate pulley assembly 8 are illustrated in exploded form below the exploded view of the chassis assembly 26 in FIG. 3. The intermediate pulley member 21 is adapted to receive at least one, but preferably multiple, windings of the cord 106 as it plays out from the spool 25 through the cord exit port 13.

A clutch shaft 2 extends parallel to the central axis and the axis of intermediate shaft 6. A centrifugal assembly 1, is coupled between the clutch shaft 2 and the right shell 24. The clutch shaft 2 is supported by clutch lock 3 which allows rotational motion of the central portion of the centrifugal assembly 1, while the peripheral portion of centrifugal assembly 1 is affixed to right shell 24. The motion of clutch shaft 2 is coupled to the intermediate pulley assembly 8 (and intermediate shaft 6) by way of pitch gear 10 (affixed to clutch shaft 2) and pitch gear 12 (affixed to intermediate shaft 6). The gears 10 and 12 are disposed within a gearbox defined by gearbox cover 4 and gearbox panel 11 affixed to the interior of chassis 14. The gearbox, and gears 10 and 12, function in a similar manner to corresponding gears described in the incorporated references.

A manual brake assembly is coupled to the clutch shaft 12, and includes a brake caliper 17, a brake hub 18 and a brake rotor 19. Operation of the brake assembly is user-controlled, by way of the brake lever 30.

Figure 8:
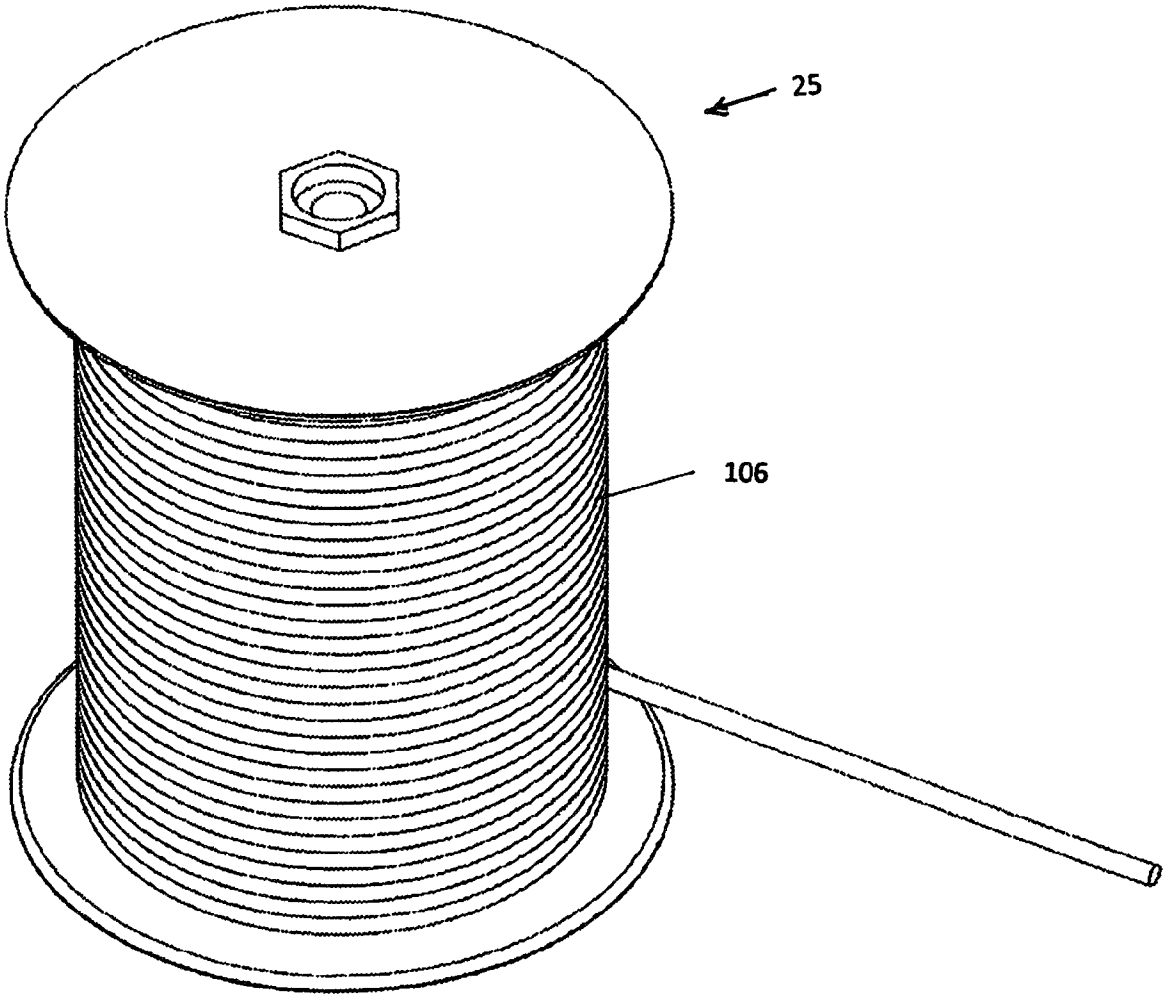
FIG. 8 shows a perspective view of a supply spool of the embodiment of FIG. 1.

While not illustrated in FIGS. 3 and 4, the cord 106 is wound around supply spool 25 (as shown in FIG. 8), with its proximal end affixed to the supply spool 25, and passing with multiple windings around a circular cross-section core (extending along and rotatable about the idler axis) the intermediate pulley member 21, and then through cord exit port 13 to its distal end at anchoring assembly 103. In illustrated embodiment, the anchoring assembly 103 is in the form of a carabiner clip. The clip is adapted for easy attachment by user, to an anchor ring connected, directly or indirectly, to the frame of a building, or some other structure. Other forms of anchoring assembly may be used, for example as disclosed in the incorporated references. Also, the escape device 100 may include an elastic force absorption member in line with the cord and the harness, again for example, as disclosed in the incorporated references.

In the illustrated embodiment, the core of the intermediate pulley member 21 has a linear conical (or concave curved conical) outer surface, so that cord 106 makes a first winding (coming from supply spool 25) having a relatively large diameter, followed by a second winding having a lesser diameter (and in a preferred form of the invention, having a third winding having a still lesser diameter), before exiting the housing through cord exit port 13. In other embodiments, different numbers of windings may be employed, and in a non-preferred, but operative, embodiment, element 21 may have a cylindrical outersurface. Also, in the preferred form of the invention illustrated herein, the rubber outer surface of the core of intermediate pulley member 21 provides a relatively high friction coefficient contact between the cord 106 and that surface. In various embodiments, the core of intermediate pulley 21 may alternatively include only a rubber, or similar characteristics material, on the outer cable-receiving surface of the pulley, or alternatively may be metallic with a textured, for example knurled, cable-receiving surface. An input cord guide element 5, rigidly coupled to the housing, includes an input central void region for allowing passage therethrough of cord 106 from the spool 25 to the core of pulley 21. An output cord guide element 13, rigidly coupled to the housing, includes an output central void region laterally offset in the direction of the idler axis from the input central void region, for allowing passage therethrough of cord 106, from the core of pulley 21 through the cord exit port 13.

With this configuration, in use, a highly controlled playout of the cord 106 is attained to under load.

The centrifugal assembly 1 can have multiple forms in accordance with the invention. In a first form the centrifugal assembly 1 is a centrifugal clutch assembly, such as a dual-shoe clutch manufactured by The Hilliard Corp., Elmira N.Y. Such a clutch assembly includes an outer member having a cylindrical (about a central axis) inner surface and an inner member which has two "shoes" disposed about the central axis. The shoes are mutually spring coupled, whereby upon rotation of a central shaft (shaft 2 in the illustrated embodiment), the shoes move radially outward (pursuant to centrifugal force) until the shoes engage the cylindrical surface, resulting in a frictional drag which limits rotational motion of the central shaft. With a centrifugal assembly 1 of this type in the escape device 100, a user upon entering the harness 114 and deploying the device 100, would encounter a relatively free fall until the shoes of the centrifugal clutch were engaged with the cylindrical surface of the centrifugal assembly 1.

Figure 5A:
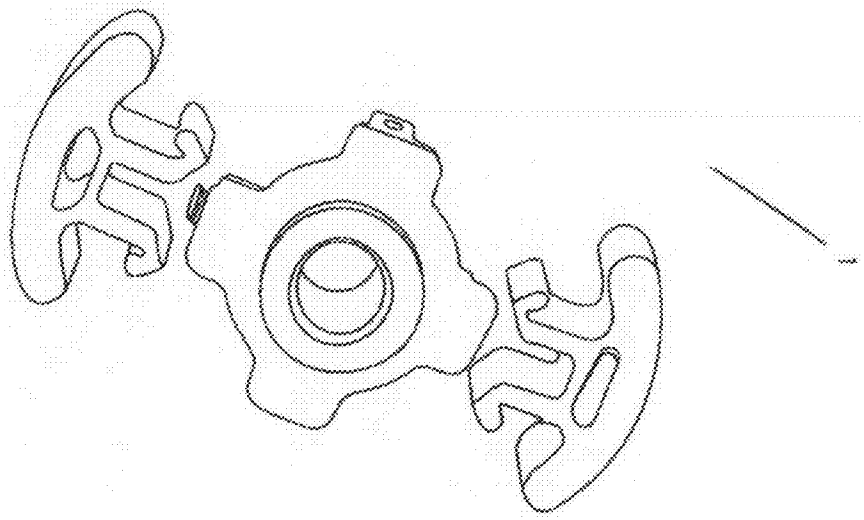
FIG. 5A shows a disassembled form of a centrifugal clutch/brake assembly of the embodiment of FIG. 1.
Figure 5B:
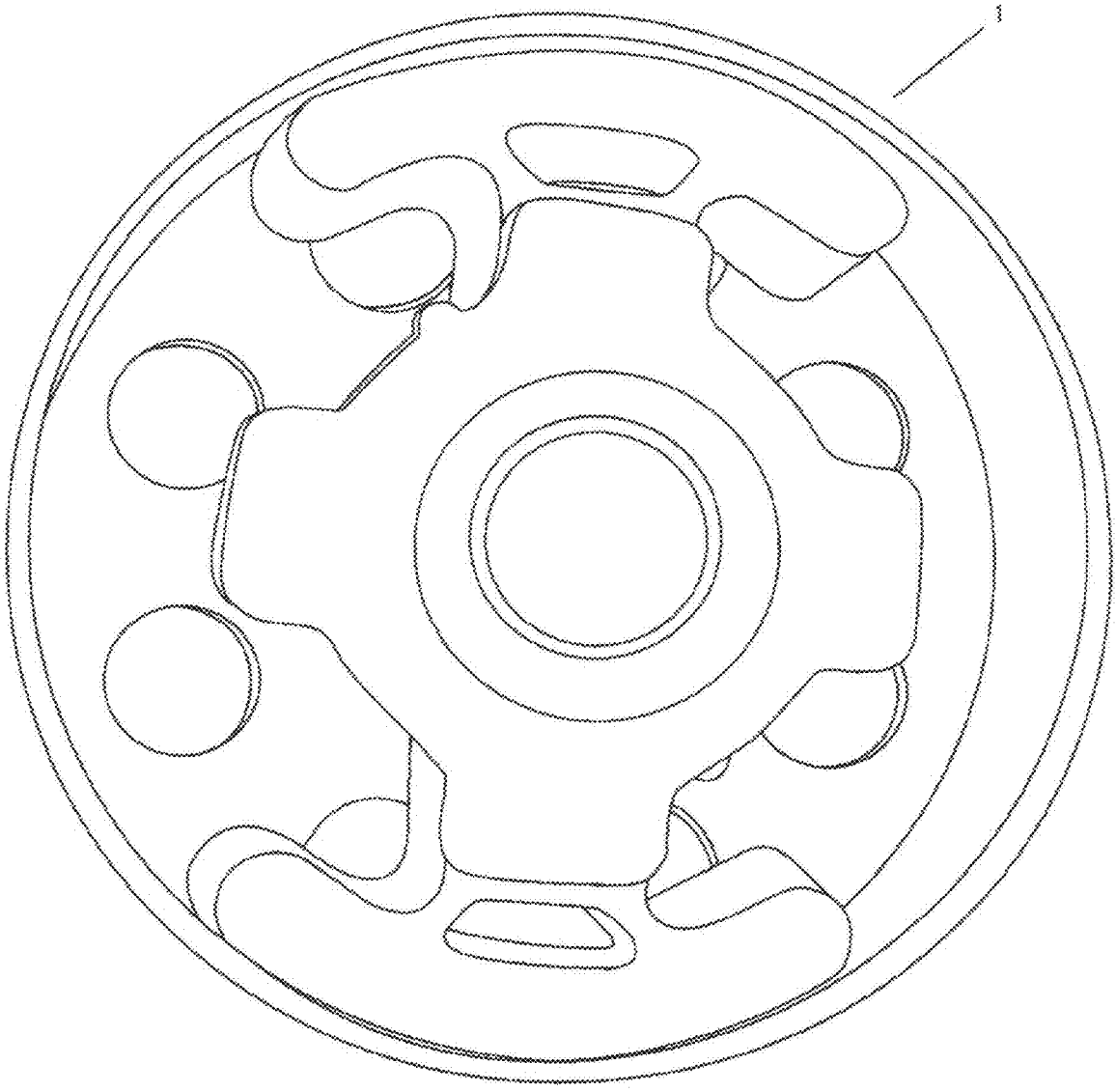
FIG. 5B shows an assembled form of a centrifugal clutch/brake assembly of the embodiment of FIG. 1.

In an alternative embodiment, the centrifugal assembly 1 has the form of a centrifugal brake assembly. In an embodiment of this type, for example, a Hilliard-type centrifugal clutch of the type described above may be modified to the form of a centrifugal brake. To effect such modification, the "normal" spring coupling of the shoes of the centrifugal clutch may be disabled (for example by removal of the springs), and radially directed cylindrical holes are drilled in inward facing surfaces of the shoes, followed by insertion of compression springs therein, so that the shoes are biased against the outer surface even when these shaft rotation rate is zero. A so-modified Hilliard clutch is shown in FIG. 5A (exploded view) and FIG. 5B (assembled). With this configuration, there is initial frictional drag on the central shaft, even at zero angular velocity of the shaft, with the frictional drag increasing as the angular velocity of the shaft increases. With a centrifugal assembly 1 of this type in the escape device 100, a user upon entering the harness 114 and deploying the device 100, would encounter a controlled velocity fall ab initio, since the shoes of the centrifugal clutch would at all times be engaged with the cylindrical surface of the centrifugal assembly 1.

Figure 6:
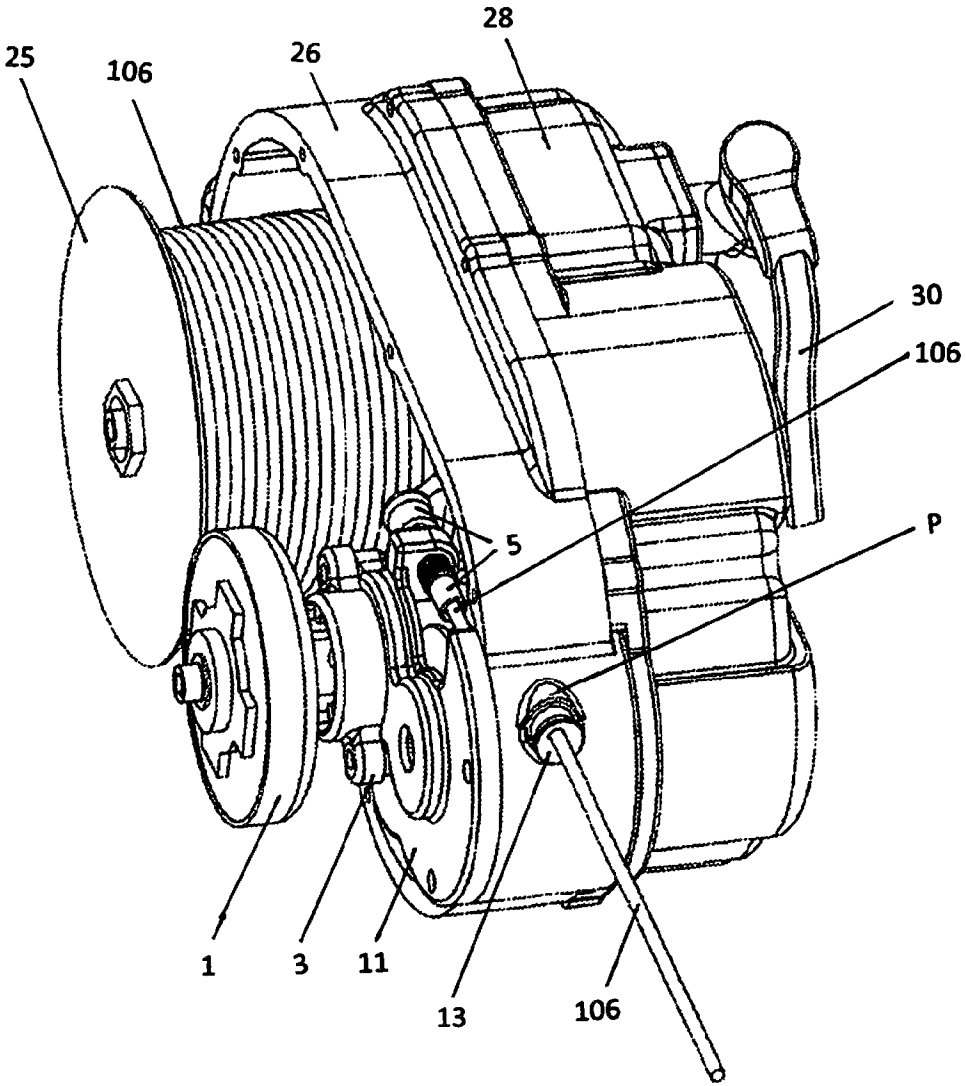
FIG. 6 shows a perspective internal view of the embodiment of FIG. 1, with half of the outer housing removed.
Figure 7:
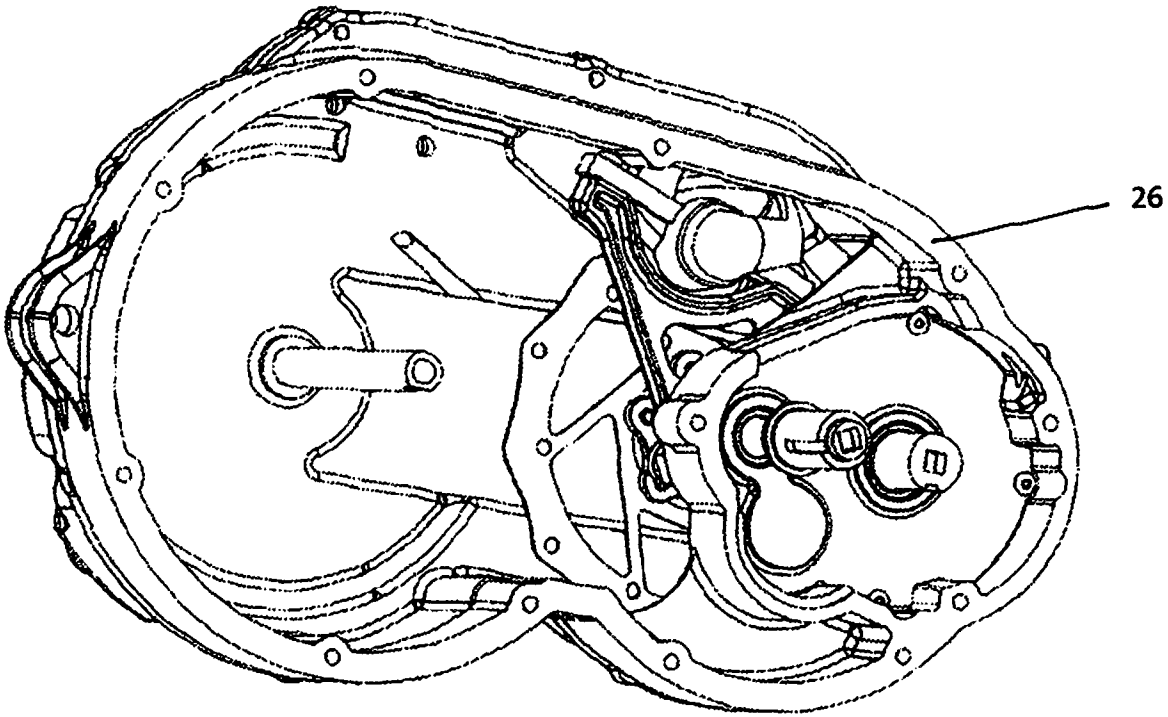
FIG. 7 shows a perspective internal view of a portion of the housing, gearbox, and brake assembly of the embodiment of FIG. 1.
Figure 9:
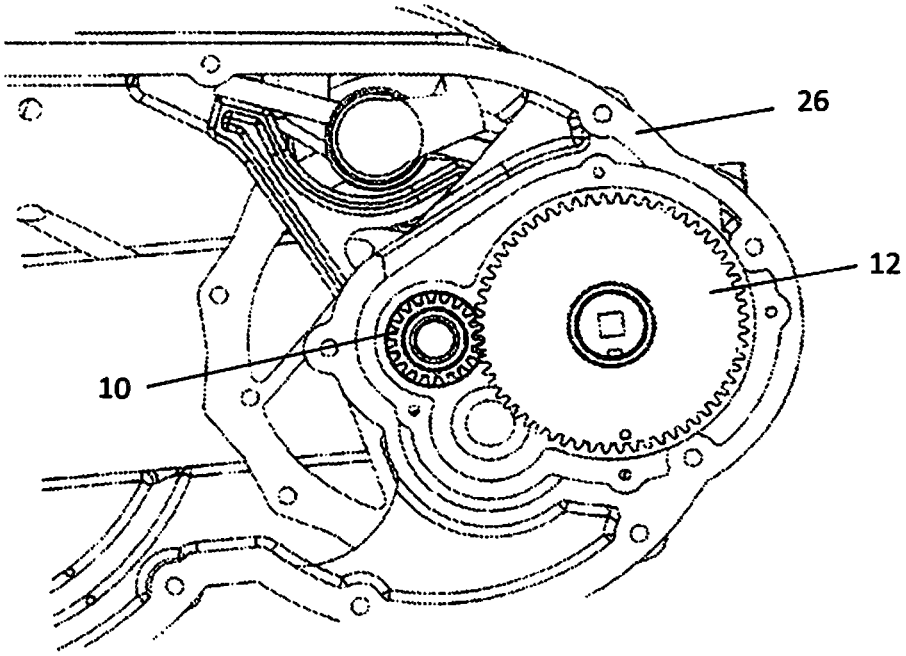
FIG. 9 shows a detail view of the gearbox of the embodiment of FIG. 1.

FIG. 6 shows an internal view of the escape device 100, with the right shell 24 removed, showing the spool 25 (fully wound with cord 106), centrifugal assembly 1, and gearbox assembly. FIG. 7 shows an internal view of the housing assembly, showing an aluminum spline, left shell 28, the gearbox, and brake assembly. FIG. 8 shows the supply spool 25, fully wound with cord 106. FIG. 9 shows the gearbox with gearbox panel 11 removed, showing pitch gear 10 and pitch gear 12.

FIG. 10 shows a table describing components and characteristics of an exemplary embodiment of the escape device 100 described above, listing the physical properties, sourced components, operational properties, and component limitations. The exemplary embodiments of the escape device 100 is adapted for use with buildings of 30 stories or less, having 400 feet of cord on supply spool 25. In other embodiments, different spools having different lengths of cord, may be used, for example, to accommodate buildings of 100 stories or more. Also, the cord in the illustrated embodiment has a diameter 5 mm. Other diameters, larger or smaller, may be used to accommodate differing payload weight limits and various regulatory codes.

Figure 11:
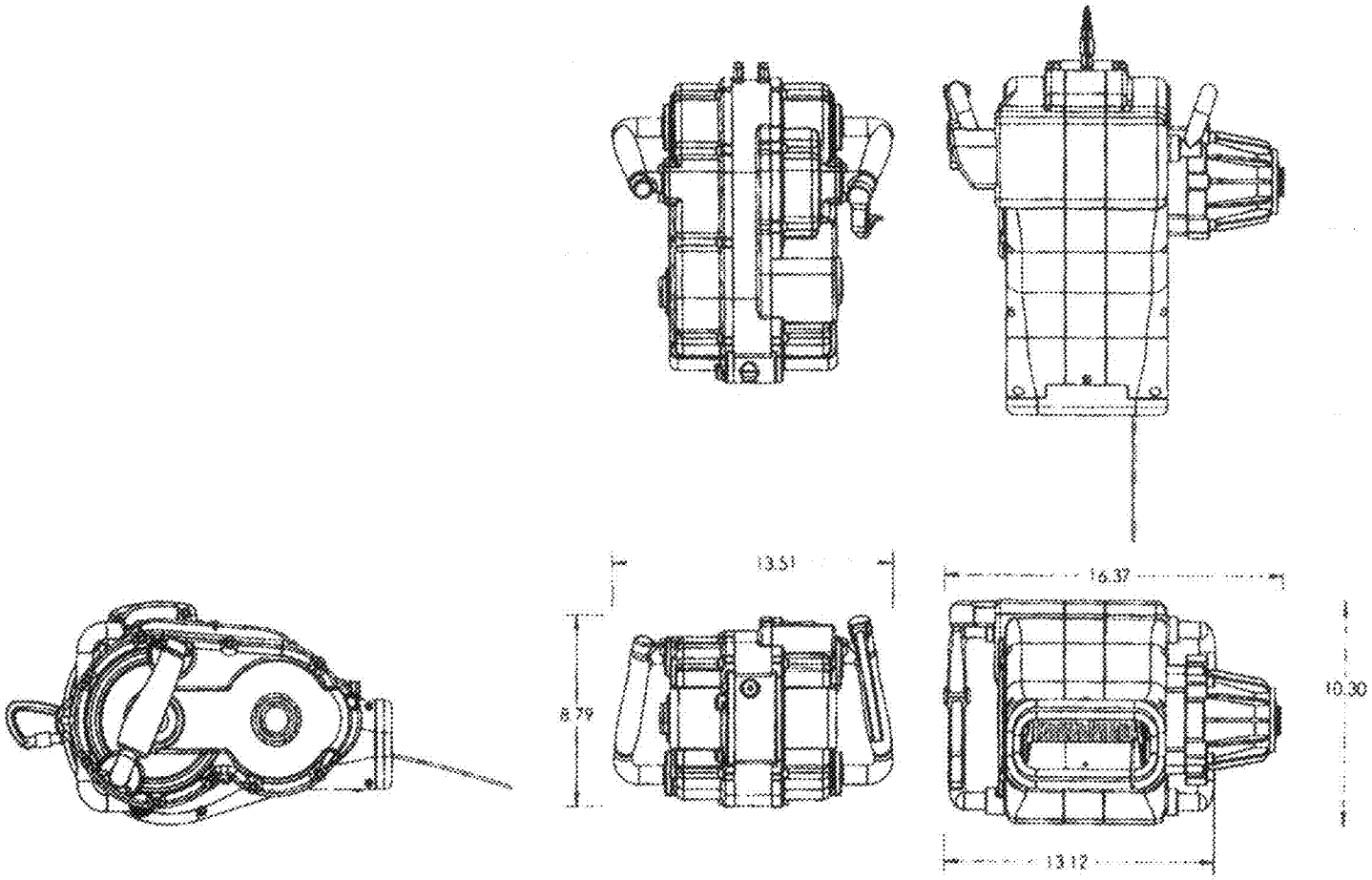
FIG. 11 shows in plan view, to exemplary embodiments of the invention.

FIG. 11 (leftmost three illustrations) shows the personal escape device described above (including exemplary dimensions, in inches) compared to an exemplary embodiment of the type disclosed in the incorporated reference, U.S. patent application Ser. No. 12/218,922 (including exemplary dimensions, in inches).

In some deployments, it is important to reuse a rescue device of the invention following use by a person, either during an evacuation of a facility, or in a subsequent evacuation of a facility. Multiple use (as opposed to single use) rescue devices are exemplified by the embodiment of the present invention, rescue device 610, illustrated in FIGS. 12 and 13. Elements in FIGS. 12 and 13 which correspond to elements in the incorporated references are identified with the same reference numbers.

Rescue device 610 is generally similar to device 100 illustrated in the incorporated references, but further is adapted to be used with a rewind, or re-spooling, assembly 612.

In the illustrated embodiment, the rewind assembly 612 includes a motor 614 with an attached battery 616. The motor 614 includes an output shaft 618 (not shown) adapted for rotary motion about a motor axis 620, and having a drive gear 622 coupled thereto. In addition, the rewind assembly 612 includes an endless belt 624 supported by spaced apart proximal roller 626 and distal roller 628, adapted for rotation about respective axes 626A and 626B extending perpendicular to the motor axis 620. A coupling assembly is disposed between the motor shaft 618 and the belt 624 to effect reciprocal motion (indicated by the arrows in FIGS. 12 and 13) of the belt 624 in a direction parallel to motor axis 620, in response to rotational motion of the motor shaft 618. A shuttle assembly 630, including a carabiner-like cable capture device, is affixed to the belt 624.

Figure 12:
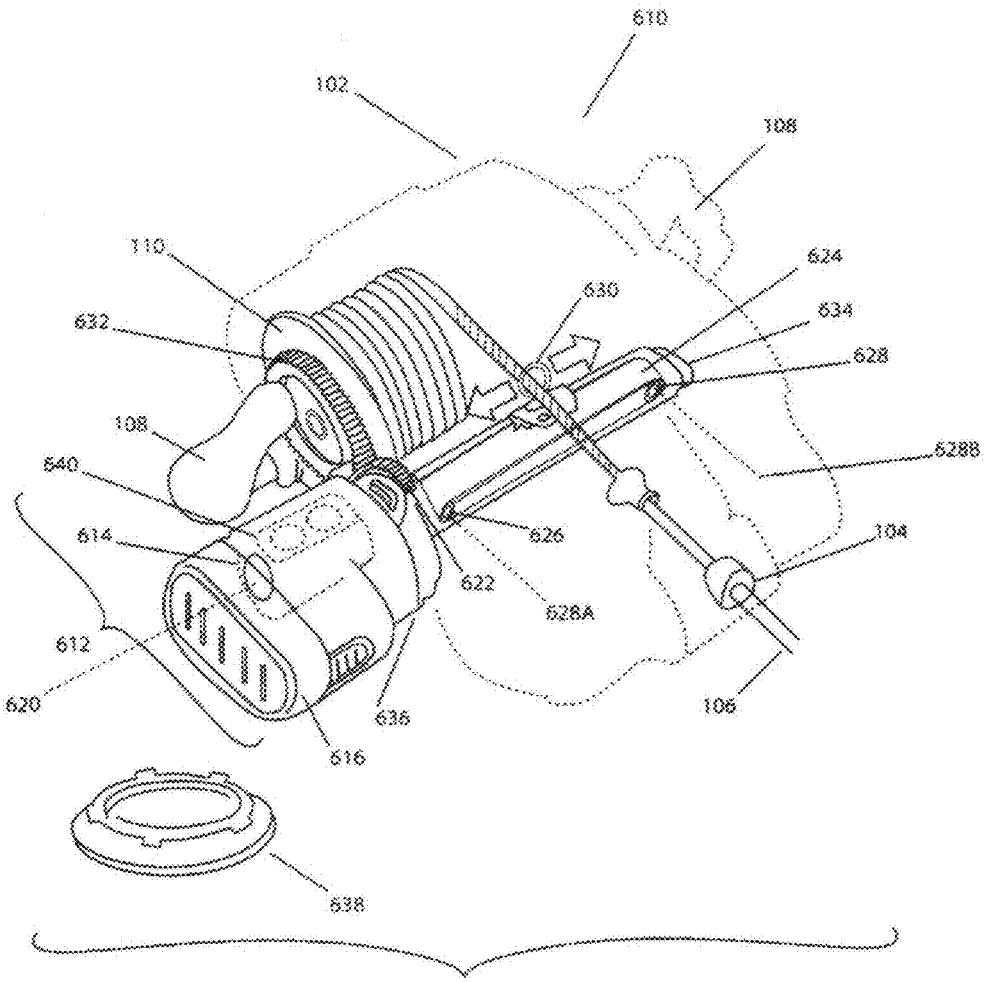
FIGS. 12 and 13 show an exemplary rewind assembly in accordance with the invention, together with a personal escape device in accordance with the invention, adapted to interfere with the rewind assembly.
Figure 13:
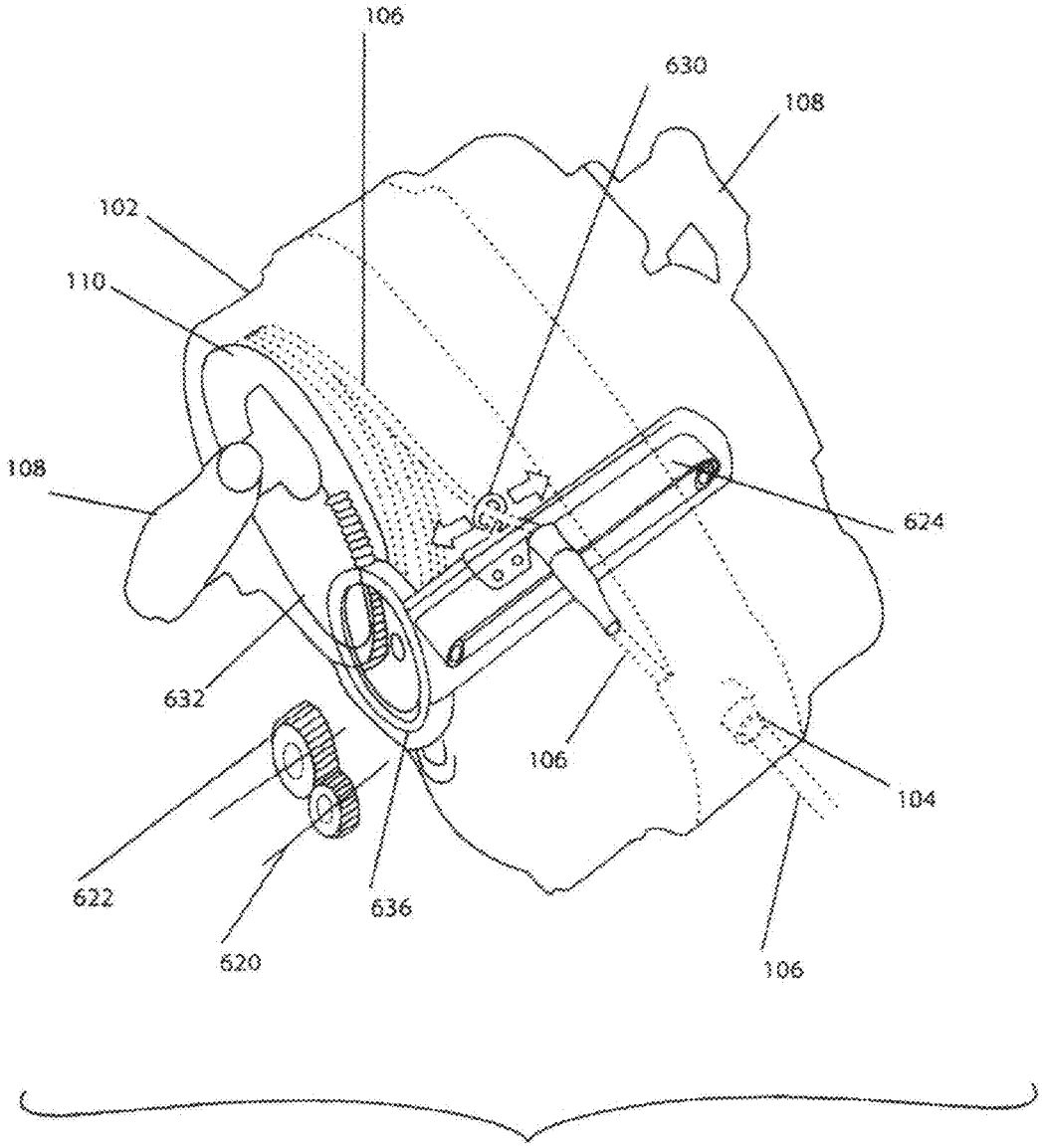

The rescue device 610 of FIGS. 12 and 13 includes components adapted to receive and support rewind assembly 612. More particularly, the spool 110 includes a spool gear 632 affixed to its proximal end, adapted for rotation along with spool 110 about its rotational axis. The housing 102 includes a belt support element 634 adapted to support the distal end of the belt 624, that is, the end near roller 628. The rescue device 610 also includes a port 636. The port 636 has an associated removable port cover 638, which when removed, allows the selective insertion (when rewind of cable 106 onto spool 110 is desired) of belt 624 and rollers 626 and 628 into housing 102, with the teeth of drive gear 622 engaged with the teeth of spool gear 632 and supporting the distal end of belt 624 at support element 634.

In operation, in order to rewind cable 106 onto spool 110, first the port cover 638 is removed from housing 102, and then, the rewind assembly 612 is mounted to device 610, inserting belt 218 so that the distal end of belt 624 is supported by support element 634, and the teeth of drive gear 622 engage the teeth of spool gear 632, and the carabiner-like cable capture device captures the cable 106.

The gearing between motor 614 and spool 110 is arranged so that, upon activation by a motor controller 640, the motor 614 drives spool gear 632 to rewind cable 106 onto spool 110. At the same time, the motor 614 drives the shuttle assembly 630 to repeatedly move the captured cable back and forth in a direction parallel to the axis of the spool 110, so that the rewound cable is substantially uniformly distributed as it rewinds on spool 110. When rewinding is completed, the carabiner-like cable capture device releases the cable 106, and the rewind assembly 612 is removed from port 636. The rescue device 610, is then ready for re-deployment. Desired inspections may be performed, as desired or required, before the rescue device 610 is redeployed.

The foregoing detailed description has been provided for a better understanding of the invention only, and some modifications will be apparent to those skilled in the art, without deviating from the spirit and scope of the appended claims.

We claim:

1. A personal escape device, comprising:

A. a housing having a port,

B. a primary spool extending along a central axis and disposed within said housing opposite said port, said primary spool being rotatably coupled to said housing to permit rotation of said primary spool about said central axis, C. an elongated cord having a proximal end and a distal and, said proximal end being affixed to said primary spool and said distal end extending through said port, said cord including a plurality of windings around said primary spool, D. a secondary spool coupled to a first idler shaft extending along an idler axis parallel to said central axis, said secondary spool being rotatably coupled to said housing to permit rotation of said secondary spool about said idler axis, and said secondary spool including an elongated, circular cross-section core extending along said idler axis, said core having a lateral surface disposed about said idler axis, and wherein said cord includes two or more mutually adjacent, single layer full windings around said secondary spool between said primary spool and said port, E. an anchor assembly extending from said distal end of said cord, including means for selectively coupling said distal end of said cord to an external object, F. a payload coupler affixed to said housing for receiving a harness assembly for supporting a payload, and G. an unwind control assembly including centrifugal assembly for controlling the rate of exit of said cord from said housing to be a predetermined function of time in response to a substantially constant pulling force on said distal end, and i. wherein said unwind control assembly includes a centrifugal brake connected by a coupling assembly between said secondary spool and said housing, and ii. wherein said centrifugal brake is disposed on a second idler shaft coupled to said housing and extending parallel to said central axis.

2. A device according to claim 1 wherein said secondary spool includes a conical outer surface for receiving said at least one winding.

3. A device according to claim 1, further including:

a. an input cord guide element having an input central void region adapted to allow passage of said cord from said primary spool to said secondary spool, and b. an output cord guide element having an output central void region adapted to allow passage of said cord from said secondary spool through said port, wherein said input cord guide element and said output cord guide element are rigidly coupled to said housing, and wherein said input central void region and said output central void region are laterally offset in the direction of said idler axis.

4. A device according to claim 3, wherein said cord extends from said primary spool, through said input central void region, at least one loop around said core, through said output central void region, and through said port.

5. A device according to claim 1, wherein said lateral surface of said core is characterized by a relatively high coefficient of friction.

6. A device according to claim 5, wherein said core is made of a resilient material.

7. A device according to claim 6, wherein said resilient material is rubber.

8. A device according to claim 5, wherein said lateral surface of said core is covered by a layer of rubber.

9. A device according to claim 5, wherein said lateral surface of said core is textured metal.

10. A device according to claim 5, wherein said lateral surface of said core is knurled metal.

11. A device according to claim 1, further including a rewind kit for rewinding said cord onto said primary spool after at least partial deployment.

12. A device according to claim 11 wherein the rewind kit comprises a selectively activatable motor, selectively coupled to the primary spool for rewinding deployed cord, and a cable distribution assembly for controlling the distribution of cord rewound on said primary spool.

* * * * *